United States Patent [19]

Lipfert et al.

[11] 4,154,069

[45] May 15, 1979

[54] DISPENSER FOR WASHING MACHINES

[75] Inventors: Donald E. Lipfert, Woolwich, Me.; Wiley A. Kittrell, Byram, Conn.

[73] Assignee: The Clorox Company, Oakland, Calif.

[21] Appl. No.: 845,078

[22] Filed: Oct. 25, 1977

[51] Int. Cl.[2] ..... D06F 39/02

[52] U.S. Cl. ..... 68/17 A; 68/207

[58] Field of Search ..... 222/416, 70; 68/17 A, 68/17 R, 18 FA, 207

[56] References Cited

U.S. PATENT DOCUMENTS

| | | | |
|---|---|---|---|
| 2,699,886 | 1/1955 | James | 68/17 R X |
| 2,975,627 | 3/1961 | Platt | 68/17 A X |
| 2,991,911 | 7/1961 | Spain | 222/67 |
| 3,057,181 | 10/1962 | Goodlaxson | 68/17 A X |
| 3,068,680 | 12/1962 | Knerr et al. | 68/17 A X |
| 3,620,054 | 11/1971 | Drews et al. | 68/17 A |
| 3,724,242 | 4/1973 | Davis | 68/17 A |

*Primary Examiner*—Philip R. Coe
*Attorney, Agent, or Firm*—Phillips, Moore, Weissenberger, Lempio & Majestic

[57] ABSTRACT

A dispenser for use on an agitator-type washing machine is provided. Means are provided for mounting the dispenser on various machines by means of an adapter. The dispenser has a body of generally cylindrical shape which may be mounted on the agitator. The dispenser includes a measuring chamber for containing a volume of liquid such as bleach, soap, etc. Also included are dispensing and timing means for dispensing the liquid in the chamber a predetermined time after the initiation of agitator action. In this manner, liquid is not dispensed until after filling of the machine has occurred. In the first embodiment, the dispensing and timing means includes a double siphon arrangement. In a second embodiment, a single siphon arrangement is used.

22 Claims, 12 Drawing Figures

FIG. 1.
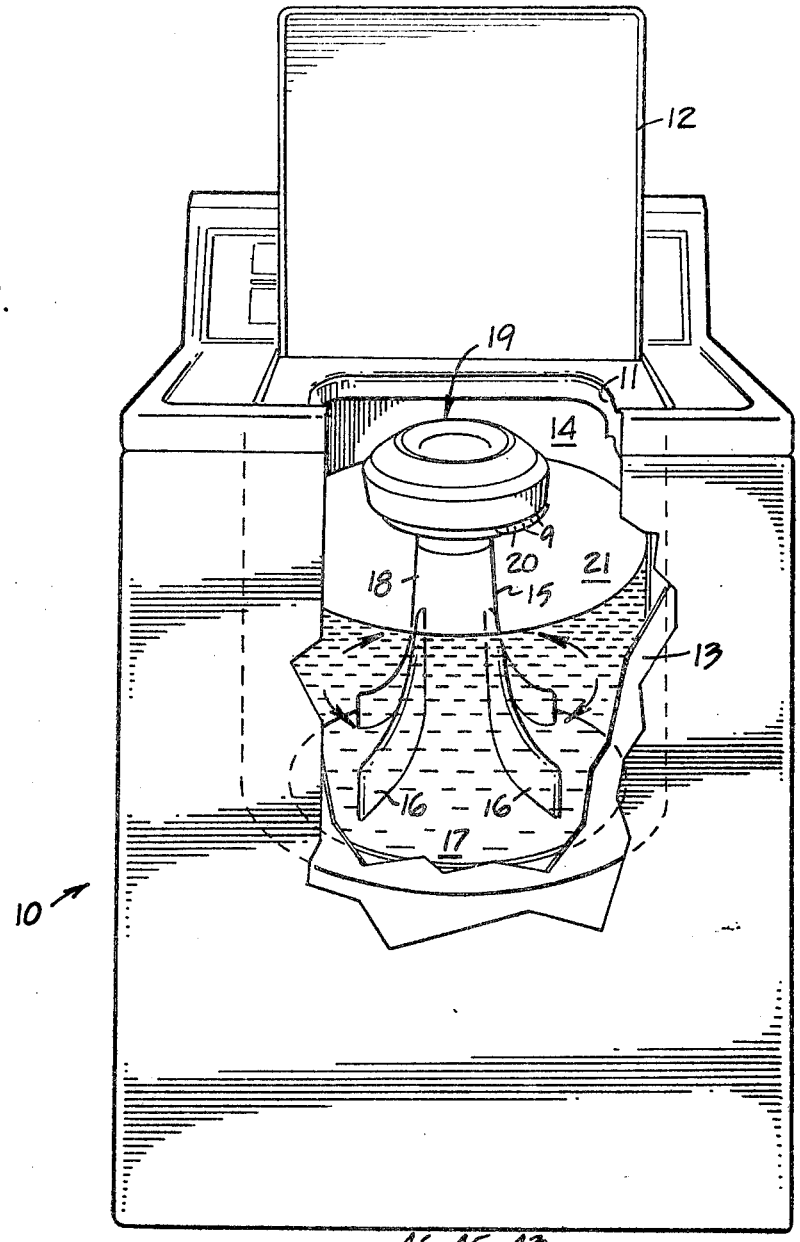
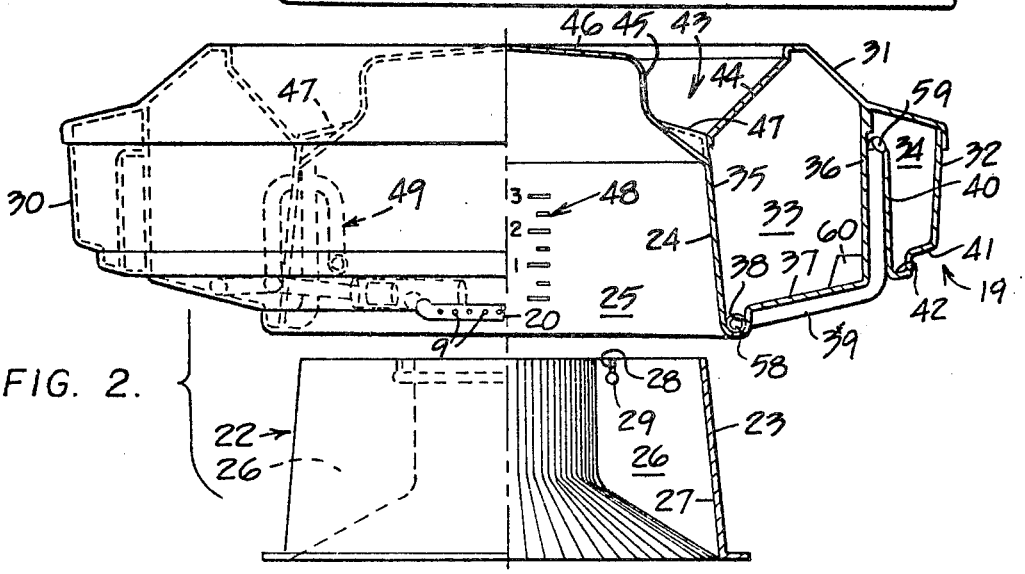
FIG. 2.

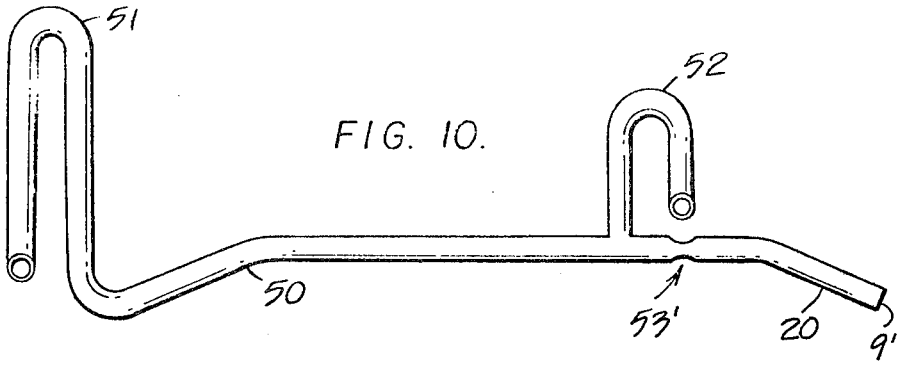
FIG. 10.
FIG. 11.
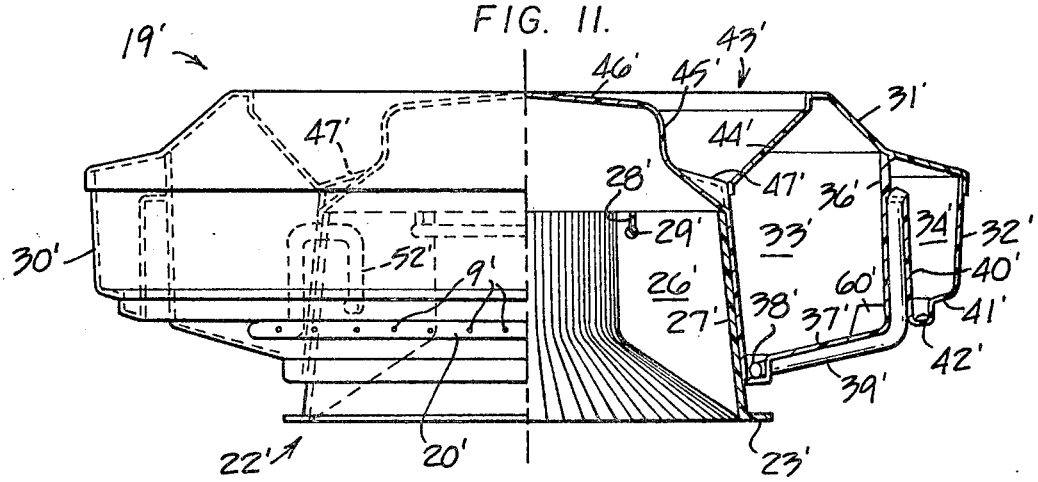
FIG. 12.
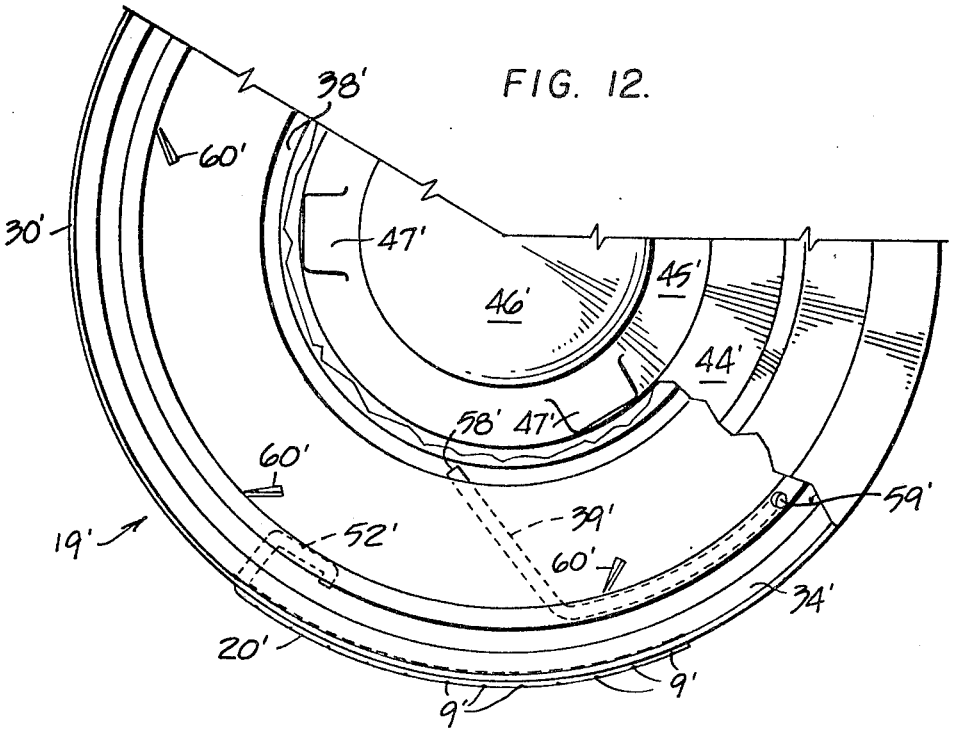

DISPENSER FOR WASHING MACHINES

BACKGROUND OF THE INVENTION

This invention relates to a dispenser device for use with automatic washing machines. More particularly, this invention is directed to an automatic siphon type dispenser for dispensing liquid into the wash water.

Clothes washing machines of the automatic type include a clothes basket into which the clothes to be washed are placed. In top loading machines, which are the kind having a vertically oriented basket with a hinged, top loading door, the clothes are loosely placed in the basket around a centrally disposed agitator. Typically, the agitator tapers from a base at the bottom of the clothes basket to a generally frustoconical end or projection spaced from the top door when in the closed or horizontal position. A plurality of agitator blades are frequently found on the sides of the agitator for disturbing the wash water and thereby removing dirt and other contaminants from the clothes.

Commonly, these automatic washing machines have control mechanisms for establishing a sequence of washing cycles. The general sequence is washing, extracting by spinning, rinsing and then extracting by spinning again. Of course, complex cycles may be used as warranted.

After the machine is loaded with clothes, and the lid closed, the first cycle of washing begins with the slow filling of the wash basket with water. This filling takes a period of several minutes. Usually, a soap or detergent which may be of granular form is used in the washing operation. The soap or detergent is generally placed in the wash basket over the clothes prior to the closing of the lid and the initiation of the washing cycles. Frequently, however, it is desirable to also add additional additives such as water softeners, fabric softeners, bleach, etc. to the machine. However, these additives should be placed in the machine after the basket has filled with water in order to ensure that the full concentration of such substances is not brought into intimate contact with the clothes.

Without some sort of automatic dispensing mechanism, this would require a monitoring of the machine and then a manual reopening of the lid after the water has filled the basket but before agitation has begun.

Some attempts to solve the problem thus posed of providing a dispenser which will insert a liquid additive to the clothes basket of a washing machine at the time after the washing cycle has started are extant in the prior art. Examples of these are found in U.S. Pat. No. 2,991,911 to Spain; U.S. Pat. No. 2,534,014 to Gayring et al; and U.S. Pat. No. 3,233,794 to Sisler. However, these prior art attempts have certain deficiencies which do not make them completely suitable for solving the problem. One deficiency with some of these prior art devices is that they are rather complex and therefore costly. They further require attachment and some integration into the workings of the washing machine with which they are used, and therefore materially add to cost. These devices typically may not be merely added to an existing washing machine but must be built into the machine at the factory, thus making them virtually inapplicable to the millions of already existing washing machines that have been sold without such automatic dispenser capability.

SUMMARY AND OBJECTS OF THE INVENTION

It is the primary object of this invention to provide an automatic dispenser for use in washing machines.

It is a further object of this invention to provide an automatic dispenser of simple construction, and having few, if any, moving parts.

It is a further object of this invention to provide an automatic liquid dispenser for washing machines which is self-energizing by means of agitator action.

It is a further object of this invention to provide an automatic dispenser for washing machines that dispenses a liquid contained therein into the machine a desired period of time after the initiation of machine operation.

It is a still further object of this invention to provide such an automatic dispenser which is adapted for use on many different types of machines.

In form, the dispenser of this invention is of torroidal or donut shape, and thereby adapted to be mounted on the end of an agitator typically found in a top loading machine. The dispenser includes a measuring chamber for containing liquid such as water softeners, fabric softeners, bleach, soap, detergent, etc. By making the dispenser of clear plastic material and having indicia thereon, the precise amount of liquid to be dispensed may be easily loaded into the dispenser. Facilitating the loading is an annular depression in the top of the dispenser body having openings therein leading to the measuring chamber. Dispensing and timing means in the form of a double siphon arrangement operate to dispense the liquid into the machine. The double siphon arrangement comprises a first siphon leading to a timing chamber and a second siphon leading to a measuring chamber. The mechanism includes the filling of the timing chamber with liquid to be dispensed after which the timing chamber siphon fills and begins to empty the fluid in the timing chamber into a discharge tube from whence it passes through a shuttle valve type through a discharge opening into the clothes basket. A second siphon tube empties the remaining liquid from the measuring chamber. In an alternate embodiment, only a single siphon tube is used.

A generally frustoconical adapter having an internal radial vane permits mounting the dispenser on various washer agitators. The mounting ring includes internal, radially spaced vanes and has an elastomeric gripping band thereon, for securely mounting the inner core of the dispenser to the agitator. The outer wall of the agitator mates with an accommodating inner bore of the dispenser.

Further and other objects and advantages of this invention will become more readily apparent from a review of the following disclosure and accompanying drawings.

BRIEF DESCRIPTION OF THE DRAWINGS

FIG. 1 is a front elevational isometric view partially cut away of a washing machine of the top loading type and having a dispenser of the instant invention mounted therein.

FIG. 2 is a side elevational exploded view of the dispenser and mounting ring or adapter, both in partial cross section;

FIG. 10 is a view of an alternate embodiment of the double siphon;

FIG. 11 is a view of an alternate embodiment of the dispenser and having a single siphon system; and, FIG. 12 is a top plan view of the dispenser of FIG. 11, partially cut away.

DETAILED DESCRIPTION

Figure 3:
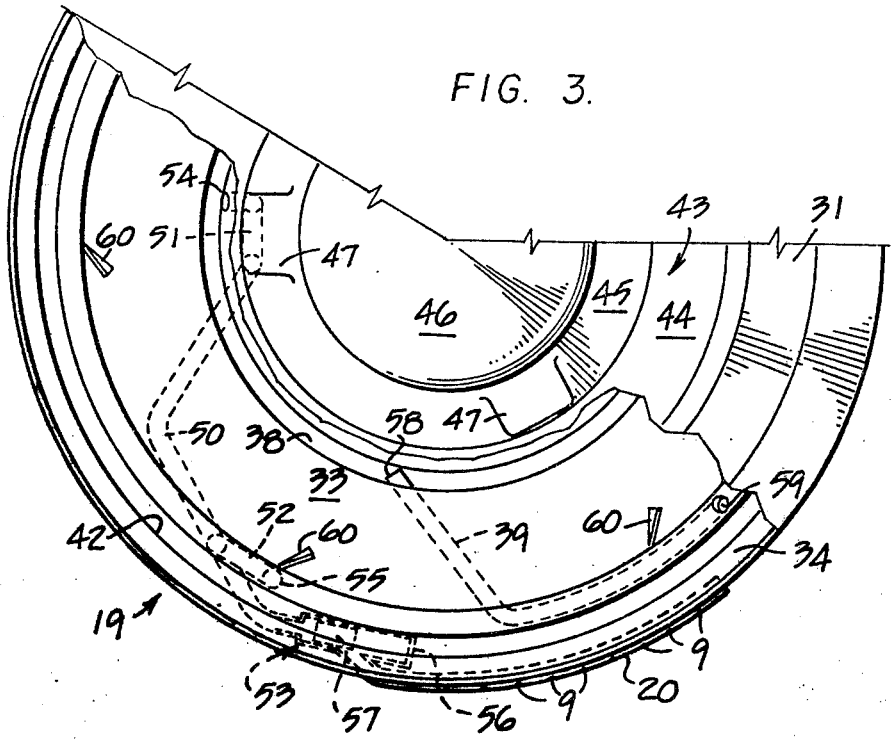
FIG. 3 is a top view partially cut away of the dispenser of FIG. 2.

Turning to FIG. 1, there is shown generally at 10 a washing machine having a top opening 11 selectively closable by means of a hinged door 12. A generally drum shaped clothes basket 13 is mounted in the machine about a vertical axis and has a clothes chamber 14 therein for receiving clothes through top opening 11.

Also located within the clothes basket on the vertical axis is a centrally disposed agitator 15. The agitator includes a plurality of agitator vanes or panels 16 equally spaced around the periphery thereof. The agitator itself includes a generally disc-shaped base 17 transcending to a generally frustoconical post or free end portion 18.

Removably mounted on the agitator post is a generally donut or torroidially shaped dispenser 19 as will be more fully described hereinafter. Like the post, the dispenser is positioned just within and spaced from the top of the door when in its closed position. Discharge tube 20 on the underside of dispenser 19 serves to distribute liquid to be dispensed into the wash water 21 as will also be described hereinafter.

Turning to FIG. 2, the dispenser and its means for mounting on the agitator post are shown. Mounting is accomplished by means of using an adapter or mounting ring 22. Mounting ring 22 has a generally frustoconical exterior wall 23 which is fittable in mating relation to accommodatingly shaped interior wall 24 of dispenser 19. Of course, if the agitator post is of the proper dimension, it may be directly fitted into the bore 25 formed by interior wall 24 in dispenser 19.

On the interior of the adapter of mounting ring 22 are located a plurality of vanes 26 in equally spaced relation. These vanes extend from inner wall 27 of adapter 22 radially inwardly to a point spaced from the central axis of the adapter. Slots 28 in the vanes serve to mount an elastic band 29 for the purpose of gripping the agitator post.

The adapter may be made of any convenient material, such as plastic. The elastic band may be made of any elastomeric material, such as rubber. The dispenser 19 itself can most effectively be constructed of clear plastic material. In this manner, the contents of the dispenser are always readily viewable which assists in filling, as will be hereinafter described. The dispenser 19 comprises a generally torroidal or donut shaped body which may be conveniently molded of pieces of plastic material. The dispenser body itself comprises a top 31 which may be lifted off of the bottom 32 as desired. The bottom defines an annular measuring chamber 33 with a radially outwardly positioned timing chamber 34 thereabout. The measuring chamber includes a pair of spaced, generally vertical sidewalls 35, 36 joined by a sloping bottom wall 37. An annular trough 38 is formed at the juncture of sidewall 35 and bottom wall 37. An impact tube or conduit 39 leads from the trough 38 along the underside of bottom wall 37 between vertical wall 36 and vertical divider wall 40 of timing chamber 34. Timing chamber 34 includes a bottom wall 41 and an annular trough 42 at the juncture of wall 41 and vertical wall 40.

Filling of the measuring chamber 33 is facilitated by means of the annular funnel 43 formed by the intersection of sloping inner wall 44 of top 31 and the sidewall 45 of central projection 46 of the dispenser body 19. Top 31 is partially supported by three raised areas 47, two of which are shown in the Figure. These raised areas permit fluid to flow from annular funnel 43 into measuring chamber 33 for filling thereof. The filling of the chamber may be gauged by means of indicia 48 which may be cast or otherwise formed in the material of the dispenser as shown on interior wall 24. Since the dispenser is made of transparent material, these indicia may be easily viewed through top 31.

A dispensing and timing means in the form of a double siphon arrangement 49 serves to dispense the fluid through discharge tube 20 after a predetermined time has elapsed. Discharge tube 20 is of arcuate construction and having a closed end with a plurality of spaced, discharge ports or openings 9 on the radially outermost portion thereof to aid in dispersion of the fluid. Acceleration forces provided by agitation cause a pressure buildup in tube 20 so as to force the liquid to be dispersed through ports 9 and thence into the wash water (not shown).

Figure 4:
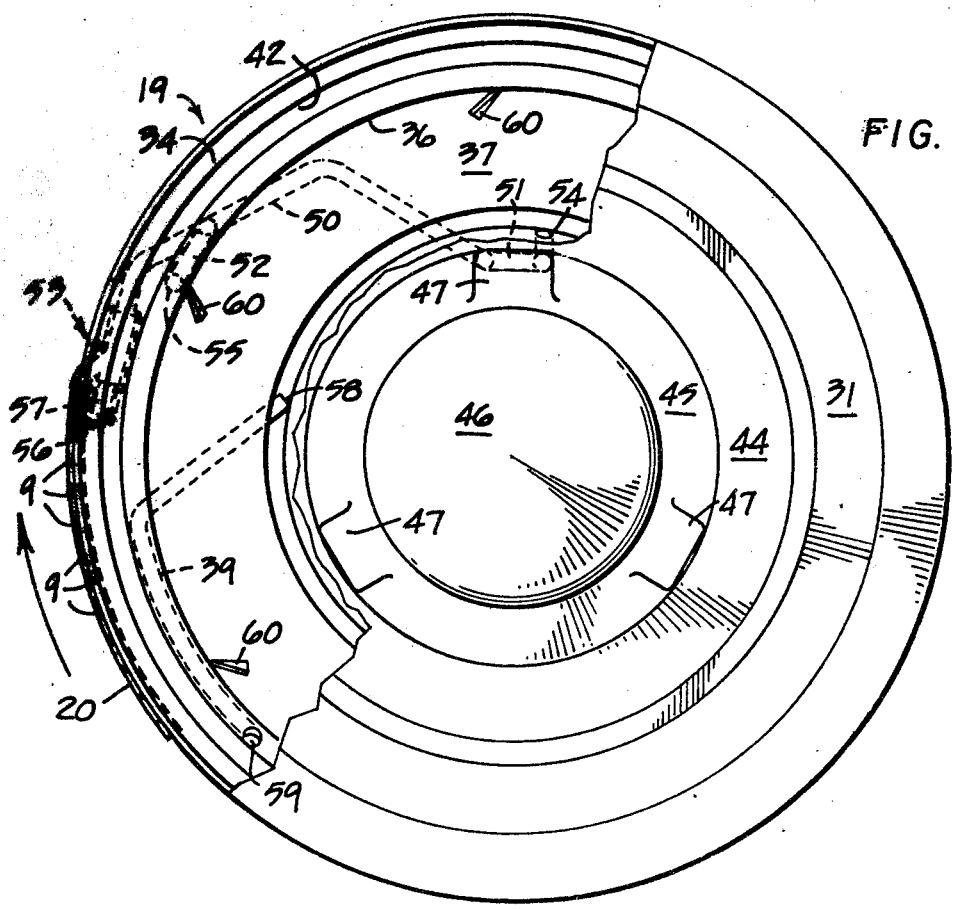
FIG. 4 is a view similar to FIG. 3 showing the dispenser advanced as during agitation.

As shown in FIGS. 3 and 4, the double siphon arrangement comprises a siphon tube 50 primarily located underneath measuring chamber 33. A first measuring chamber siphon 51 leads from measuring chamber 33 to siphon tube 50. A second timing chamber siphon 52 leads from timing chamber 34 to a point in siphon tube 50 which leads into centrifugally actuable shuttle type pump 53. As may be seen, the open or inlet end 54 of siphon 51 is located within annular trough 38. Since wall 37 (see FIG. 1) slopes towards this annular trough, such location permits the full draining of the measuring chamber by the double siphon arrangement as will be more fully described hereinafter.

As seen in these Figures, one end 58 of impact tube 39 is angled so that agitator action causes tube end 58 to move relative to the contained liquid within measuring chamber 33. This causes the liquid to rise in impact tube 39 and be discharged into timing chamber 34 over a period of time through outlet opening 59 in impact tube 39.

Figure 5:
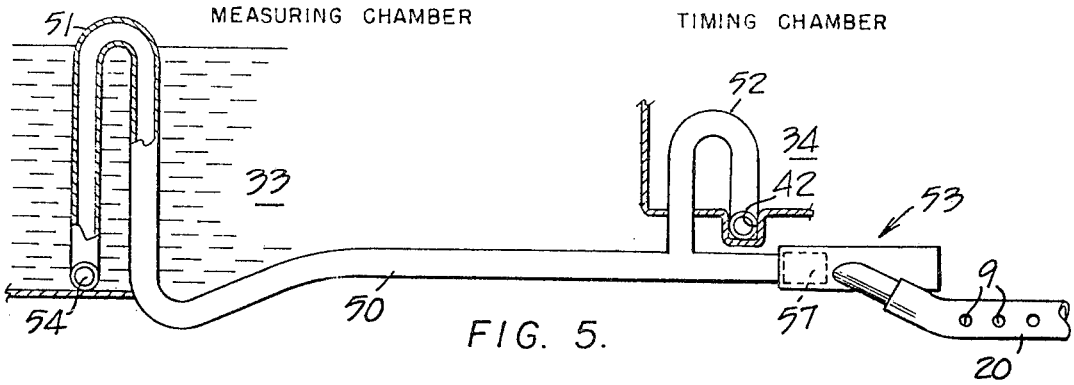
FIGS. 5 through 8 show the double siphon system of the instant invention in various sequential stages of operation.

FIG. 5 shows the timing chamber just prior to filling by the impact tube. In one direction of rotation of the agitator, the impact tube impacts the liquid causing it to enter the tube and forcing it to rise. Outlet opening 59 is positioned to be above the maximum fill level in the timing chamber. Liquid entering the impact tube under impact pressure rises and moves outwardly with centrifugal force aiding its flow.

Since agitator action is intermittent, the flow into the timing chamber is also intermittent. Nevertheless, the chamber fills at a relatively constant rate. In order to ensure that the open end 58 of the impact tube is not uncovered by the centrifugal force of agitator action, a plurality of small vanes 60 are spaced around the periphery of the chamber at the juncture between verticall wall 36 and horizontal wall 37.

A higher liquid levels, the same vanes tend to drive liquid in the direction of rotation, thereby reducing the impact pressure at the tube end 58. This tends to reduce the variation of flow rate in impact tube 39 otherwise caused by changes in fill level.

Figure 6:
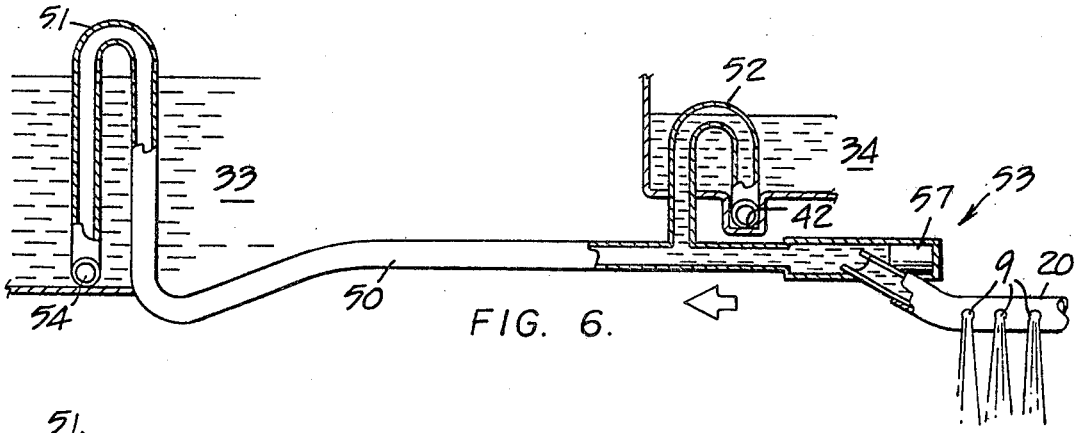
Figure 7:
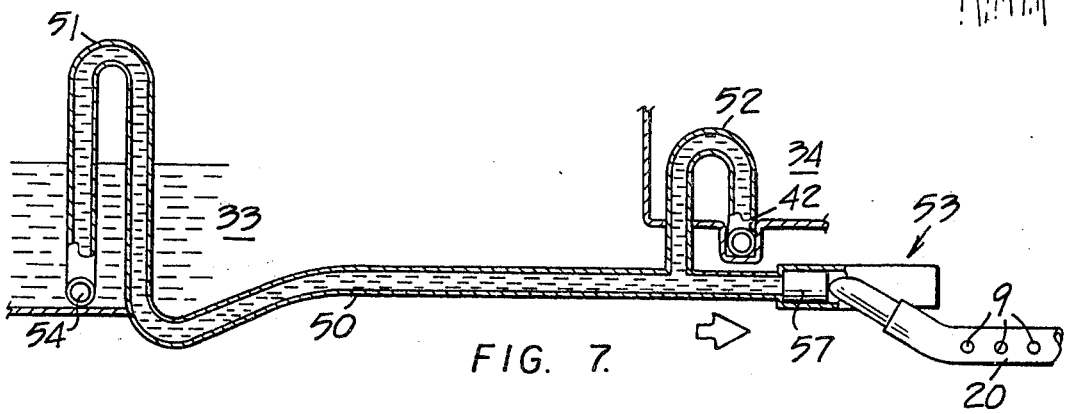

As the timing chamber 34 fills at a relatively constant rate, in a predetermined time, the rise in liquid level will fill timing chamber siphon 52 and outflow will begin, as best seen in FIG. 6. This outflow will continue because of siphon action until the timing chamber is empty, as best seen in FIG. 7.

Figure 8:
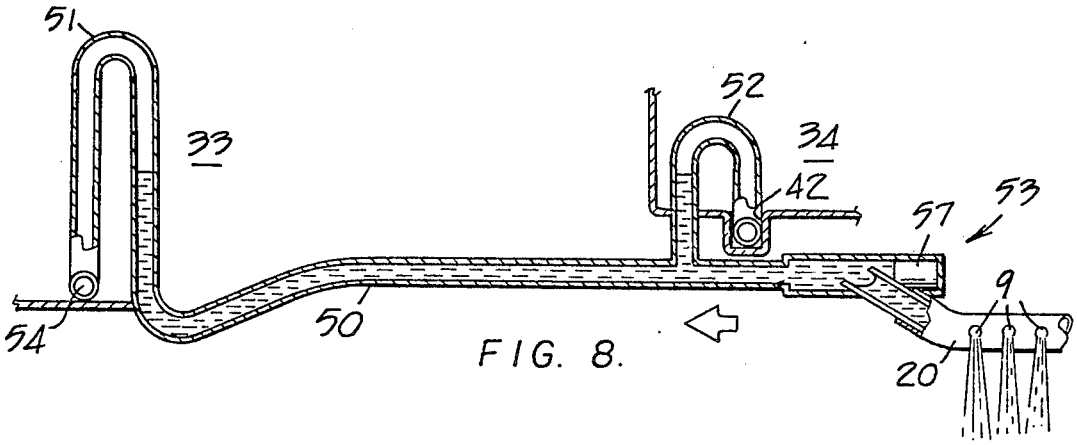
Figure 9:
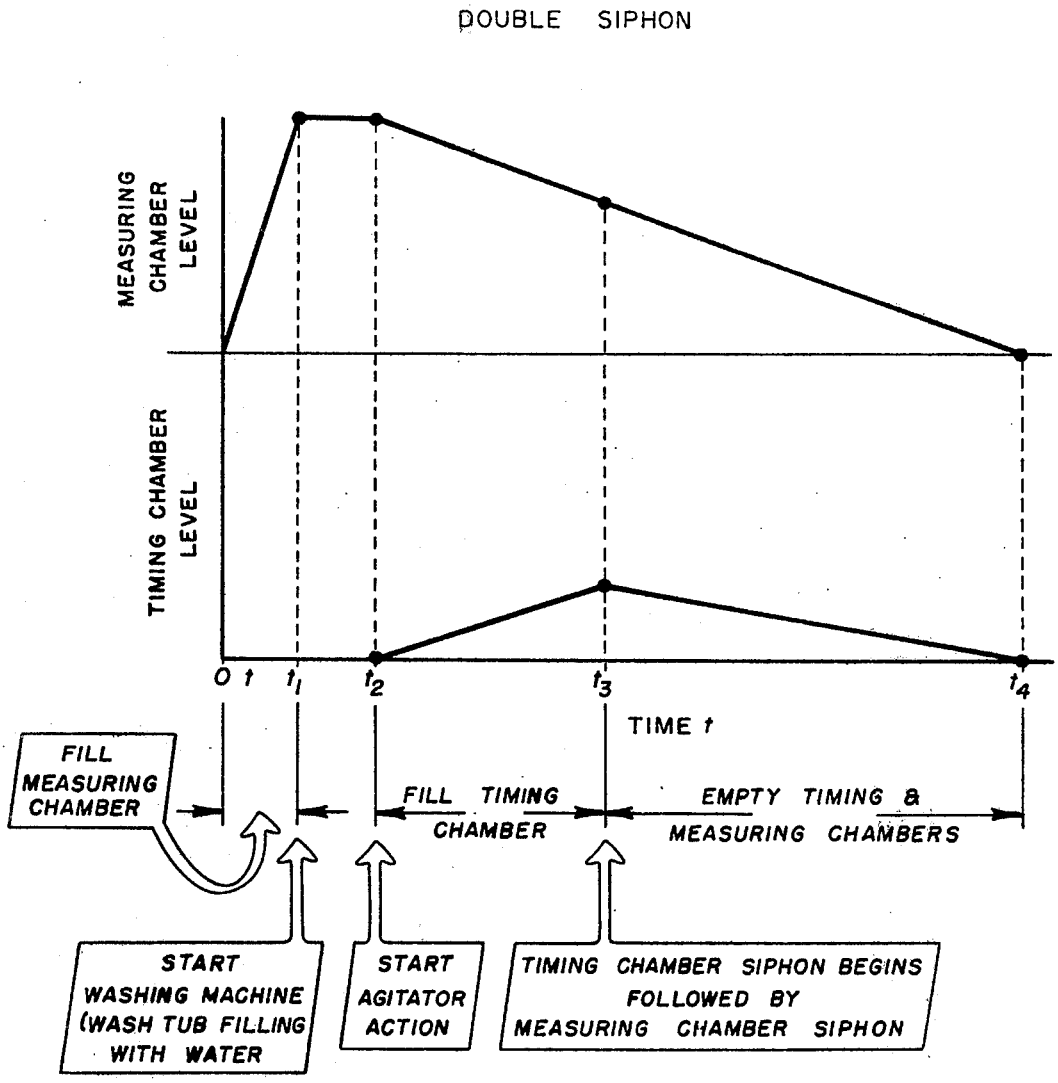
FIG. 9 is a graphic illustration of the double siphon system operation.

The liquid flowing out of siphon 52 into siphon tube 50 is impeded by shuttle pump 53 as the agitator rotates counterclockwise, so that flow is momentarily diverted inwardly towards measuring chamber siphon 51. Upon reversal of agitator motion, centrifugal force causes slug 57 to move in the opposite direction causing a partial vacuum in siphon tube 50, thereby causing siphon 51 to fill. Flow through siphon 51 continues intermittently until the measuring chamber is emptied, as seen in FIG. 8. As may be appreciated by viewing FIG. 9, the initial time delay from the start of the washing machine to t1 to the start of agitator action at t2 plus the filling of the timing chamber to t3 results in a predetermined desired time delay for emptying of liquid into the washing machine. As may be appreciated from the graph of FIG. 9, both chambers then empty from time t3 to t4 in a simultaneous manner. The siphons are positioned so that centrifugal force does not trigger them prematurely.

As seen in FIG. 10, an alternate embodiment of the double siphon arrangement is possible wherein the pump is replaced by the constriction 53'. The constriction in the tube serves the same purpose as in the previously described shuttle type pump. As also seen in this Figure, the discharge from the siphon may alternatively be simply an opening 9' in the end of tube 20.

Turning to FIGS. 11 and 12, a single siphon version is also possible which eliminates the measuring chamber siphon. With this embodiment, a single siphon 52' is used to transfer liquid from timing chamber 34' through discharge tube 20'. As with the first embodiment described above, the timing chamber is filled by means of impact tube 39' which fills the timing chamber in response to the reciprocating motion imparted to dispenser 19' by agitator action.

The time delay is created by the time required to fill the timing chamber to the point where siphon 52' begins to operate. The operation continues until all of the fluid from measuring chamber 33' has been transferred into timing chamber 34' and thence is expelled through discharge tube 20'.

It is believed that the operation of the dispenser is sufficiently clear from the above description. Nevertheless, the operation will be further described as follows. Having reference to FIG. 2, the mounting of adapter 22 is accomplished by forcing it over the agitator post, the dimensions of which vary with different brands of washing machines. Inward facing vanes 26 of mounting ring 22 are flexible so as to be capable of deflection. Elastic band 29 acts as a spring biasing means to urge the blades into the small center space. With the ring 22 inserted into bore 24 of dispenser 19, the dispenser may be forced down with a twisting motion so that the blades bend to admit the diameter of the agitator post that it is forced against. Vanes 26 will deflect uniformly, thereby centering the dispenser. Elastic band 29 will be expanded to maintain sufficient force for the dispenser to follow agitator motion.

Liquid to be dispensed is then poured into dispenser 19 through annular funnel 43 to the desired fill level as measured by indicia 48. Indicia 48 may conveniently provide cup and fractional cup indication.

The washing machine lid is then closed and the machine cycle started by means of actuating the machine control (not shown). The dispenser will then dispense fluid into the wash water a predetermined time after initiation of agitator action.

It is to be understood that the foregoing description is merely illustrative of the preferred and alternate embodiments of the invention and that the scope of the invention is not to be limited thereto, but is to be determined by the scope of the appended claims.

What is claimed is:

1. For use in a washing machine having a reciprocable agitator which is reciprocable about a vertical axis, a liquid dispenser having means thereon for mounting said dispenser on the agitator and reciprocable therewith, said dispenser having a measuring chamber for containing a volume of liquid to be dispensed, and dispensing and timing means for dispensing a volume of liquid a predetermined time after initiation of agitator action, said dispensing and timing means comprising a timing chamber for receiving liquid and means responsive to reciprocable agitator motion for transferring liquid from said measuring chamber to said timing chamber over a period of time.

2. The invention of claim 1 wherein said dispensing and timing means further comprises a first siphon positioned in relation to said timing chamber to dispense liquid from said timing chamber exterior of said dispenser and into the washing machine so as to empty said timing chamber.

3. The invention of claim 2 wherein said dispensing and timing means further comprises a second siphon positioned in relation to said measuring chamber to dispense liquid from the measuring chamber exterior of said dispenser and into said washing machine so as to empty said measuring chamber.

4. The invention of claim 3 wherein said dispensing and timing means includes conduit means intercommunicating said first and second siphons whereby operation of said first siphon causes operation of said second siphon.

5. The invention of claim 4 wherein said conduit means includes a discharge outlet for discharging liquid from said conduit means into the washing machine, and further including check valve means for permitting flow of liquid into said washing machine through the outlet while preventing back-flow of liquid into said measuring and timing chambers.

6. The invention of claim 5 wherein said check valve means comprises a piston reciprocable past said outlet and said conduit means so as to cut off communication between said conduit means and said outlet in one direction of reciprocation of the agitator and to permit communication in an opposite direction of reciprocation.

7. The invention of claim 5 wherein said check valve means comprises a restriction in said conduit means.

8. The invention of claim 1 wherein said means responsive to reciprocable agitator motion comprises a transfer conduit intercommunicating said measuring chamber with said timing chamber, said transfer conduit being positioned with relation to the direction of agitator motion and said measuring and timing chambers so that centrifugal forces generated by said agitator motion causes liquid to be transferred from said measuring chamber to said timing chamber over a period of time.

9. The invention of claim 8 wherein said transfer conduit has an inlet opening and an outlet opening, said inlet opening being positioned adjacent said bottom wall of said measuring chamber, and further including protuberances in said measuring chamber for assisting movement of liquid to said inlet opening so as to ensure fluid communication with said inlet opening.

10. The invention of claim 9 wherein said protuberances comprise a plurality of blades mounted on said walls and extending into said liquid in said measuring chamber.

11. The invention of claim 1 wherein said dispenser is a generally cylindrically shaped body defining a central axis and having a co-axial centrally disposed opening therethrough for positioning over the agitator, and wherein said measuring and timing chambers are formed within said body and are generally annular in shape.

12. The invention of claim 11 wherein said body includes a generally circular funnel portion for directing and admitting liquid to said measuring chamber.

13. The invention of claim 1 wherein said measuring chamber defines side walls and further including indicia on said side walls whereby the volume of liquid added to said measuring chamber may be easily determined.

14. The invention of claim 1 wherein said dispenser is made of transparent material wherein the liquid contents therein may be viewed.

15. The invention of claim 1 further including an adapter matable with said dispenser for mounting said dispenser on said agitator.

16. The invention of claim 15 wherein said dispenser includes an axial mounting bore, and wherein said adapter is dimensioned to mate with said mounting bore.

17. The invention of claim 16 wherein said adapter is generally tubular defining an exterior surface adapted to mate with said axial mounting bore, and further including a plurality of spaced, vanes therein projecting inwardly toward but short of said vertical axis so as to encompass the agitator.

18. The invention of claim 17 wherein said adapter further includes gripping means for gripping said agitator.

19. The invention of claim 18 wherein said gripping means is a band of elastic material mounted on said vanes.

20. The invention of claim 1 wherein said dispensing and timing means includes means for dispersing said liquid to be dispensed.

21. The invention of claim 20 wherein said means for dispersing comprises a tube having a plurality of dispensing openings located thereon.

22. The invention of claim 21 wherein said tube is generally arcuate in shape defining a radially outermost portion and wherein said openings are located on said portion.

* * * * *